US005222779A

United States Patent [19]

Johnson

[11] Patent Number: 5,222,779

[45] Date of Patent: Jun. 29, 1993

[54] CHAISE LOUNGE

[76] Inventor: Douglas W. Johnson, 2842 Chapman Ct., Marietta, Ga. 30066

[21] Appl. No.: 887,855

[22] Filed: May 26, 1992

[51] Int. Cl.[5] ..... A47C 31/00; A47C 17/66

[52] U.S. Cl. ..... 297/191; 5/638; 297/452; 297/463; 297/460

[58] Field of Search ..... 297/191, 452, 460, DIG. 3, 297/463; 5/638

[56] References Cited

U.S. PATENT DOCUMENTS

| | | | |
|---|---|---|---|
| D. 295,581 | 5/1988 | Mallin | D6/361 |
| D. 296,618 | 7/1988 | Colby | D6/361 |
| D. 297,288 | 8/1988 | Raney | D6/361 |
| D. 297,985 | 10/1988 | Kaminski | D6/361 |
| D. 298,096 | 10/1988 | Kaminski | D6/501 |
| D. 298,992 | 12/1988 | Voss | 5/638 X |
| D. 302,768 | 8/1989 | Grosfillex | D6/361 |
| D. 316,490 | 4/1991 | Masrtin | D6/361 |
| 2,236,770 | 4/1941 | Atwell | 5/638 X |
| 3,897,102 | 7/1975 | Lemaire | 297/191 |
| 4,521,054 | 6/1985 | Deconinck | 297/357 |
| 4,606,086 | 8/1986 | Rowland | 297/452 X |
| 4,723,329 | 1/1988 | Vollaro | 5/638 X |
| 4.773,708 | 9/1988 | Nastu | 297/423 |
| 4,891,854 | 1/1990 | Finkelstein | 297/452 X |

FOREIGN PATENT DOCUMENTS

| | | | |
|---|---|---|---|
| 2027671 | 4/1972 | Fed. Rep. of Germany | 297/DIG. 3 |

*Primary Examiner*—Peter R. Brown

*Attorney, Agent, or Firm*—Timmons & Kelly

[57] ABSTRACT

At times a person may wish to lie on a chaise lounge in a prone position. The chaise lounge has a head support section that includes a head rest. The head rest has a T-shaped or triangular opening for accommodating the person's face. The head support section also has an area of reduced width to accommodate the person's arms. The person can thus hold and read a book or magazine located below the chaise lounge.

9 Claims, 2 Drawing Sheets

CHAISE LOUNGE

BACKGROUND OF THE INVENTION

1. Field of the Invention

This invention relates in general to furniture. In particular, the invention relates to chaise lounges on which people may lie in a prone position.

2. Description of Related Art including information disclosed under 37 C.F.R. §§1.97–1.99

When a person is sunbathing, a certain amount of time must be spent in a prone position in order to tan the back. When lying in a prone position on a chaise lounge, it can be uncomfortable to place one's face downward against the supporting surface of the chaise lounge. Therefore, a prone person will usually turn his or her head to one side or the other, placing one ear against the supporting surface. This position causes the neck to be turned a full 180 degrees, and can cause severe aches and pains.

One alternative is for the person to raise his or her upper torso up off of the supporting surface and to rest his or her weight on his or her elbows. This position is used particularly when the person wishes to read a book or magazine while sunning. The obvious disadvantages of this position are the extraordinary stresses that are placed on the back and arms.

Another option is to lie with one's arms and head extending beyond the end or over the side of the chaise lounge. In either of these positions, the person must support his or her head with his or her neck in a cantilever fashion. The neck must be kept tense in order to support the head, and the dire consequences are easily predicted.

Prior art chaise lounges require such positions, because the surfaces of the chaise lounges do not accommodate the person's face or arms. Such apparatus do not have any openings in which the person can place his or her face or arms.

Some tables on which people lie in a prone position have openings for accommodating the person's face. Such tables have been used for physical therapy, for chiropractic treatment, and for massage therapy.

SUMMARY OF THE INVENTION

The general object of the invention is to provide a chaise lounge for supporting a prone person, and to accommodate the person's face and arms. In general, this object is accomplished by a chaise lounge having a T-shaped or generally triangular opening for accommodating the person's face, and an area of reduced width for accommodating the person's arms.

The chaise lounge of the invention has a body support section for supporting the person's body. The chaise lounge may also include a separate leg support section for supporting the person's legs and a body support section for supporting the person's torso.

Attached to the body support section is a head support section for supporting the person's shoulders, head, and upper chest. The head support section has a T-shaped or generally triangular opening for accommodating the person's face. The head support section also has an area of reduced width for accommodating the person's arms. The head support section may be stuffed with a filler material, or may be inflatable.

The chaise lounge of the invention may also include a soft, removable cover for the head support section.

The cover may also have a T-shaped or generally triangular opening for accommodating the person's face.

The above, as well as additional objects, features, and advantages of the invention will become apparent in the following detailed description.

DESCRIPTION OF THE PREFERRED EMBODIMENT

Figure 1:
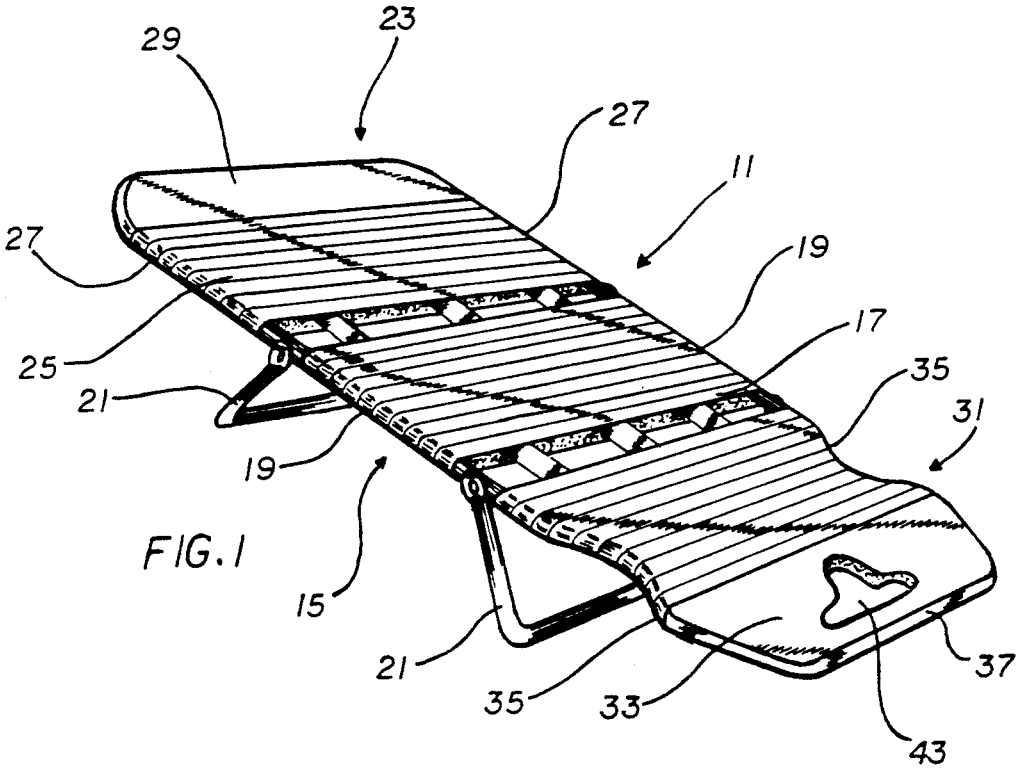
FIG. 1 is a perspective view of a chaise lounge according to the invention.
Figure 2:
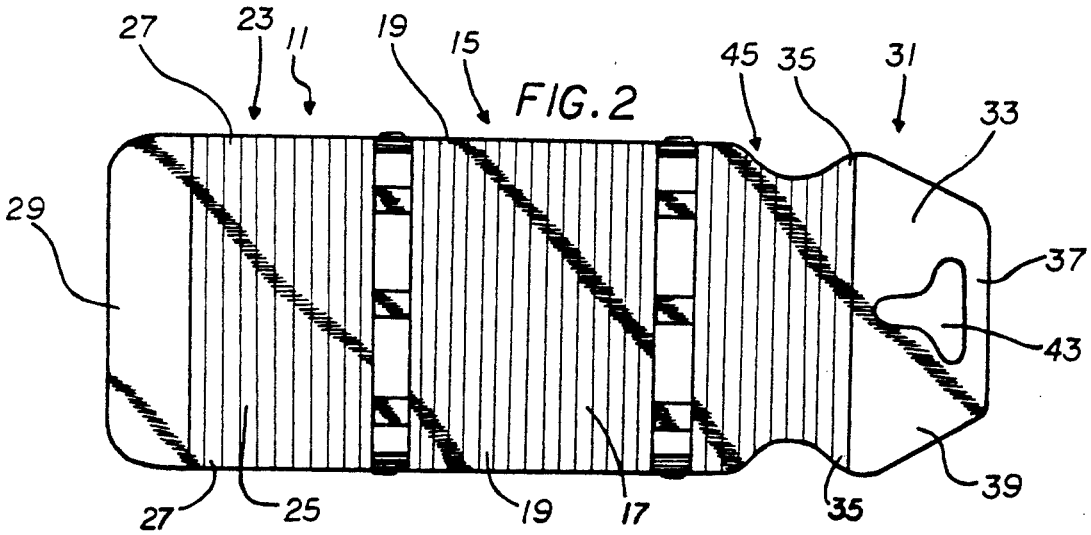
FIG. 2 is a top plan view of the chaise lounge.

As shown in FIGS. 1 and 2, the chaise lounge 11 of the invention has a body support section 15 having a horizontal surface for supporting the torso of a prone person 13. The body support section 15 has a vinyl or plastic covering 17 stretched between a parallel pair of sides 19. The covering 17 may be a single piece of material, a plurality of strips, or a webbing of interlaced strips.

A support, such as a pair of legs 21, holds the body support section 15 about one foot off of a supporting structure, such as a patio or the ground. The legs 21 are attached to each end of the body support section 15 and can be pivoted between an open position, as shown in FIG. 1, and a closed position in which the legs 21 are folded up against the body support section 15.

A leg support section 23 is attached to one end of the body support section 15 and has a horizontal surface for supporting the person's legs. The leg support section 23 can be pivoted to several different positions relative to the body support section 15, including a closed position in which the leg support section 23 is folded against the body support section 15. The leg support section 23 has a vinyl or plastic covering 25 stretched between a parallel pair of sides 27 and a bottom 29. The covering 25 may be a single piece of material, a plurality of strips, or a webbing of interlaced strips.

A head support section 31 is attached to the opposite end of the body support section 15 and has a horizontal surface for supporting the person's head, shoulders, and upper chest. The head support section 31 can be pivoted to several different positions relative to the body support section 15, including a closed position in which the head support section 31 is folded against the body support section 15. The head support section 31 has a vinyl or plastic covering 33 stretched between a parallel pair of sides 35 and a bottom 37. The covering 33 may be a single piece of material, a plurality of strips, or a webbing of interlaced strips.

Figure 4:
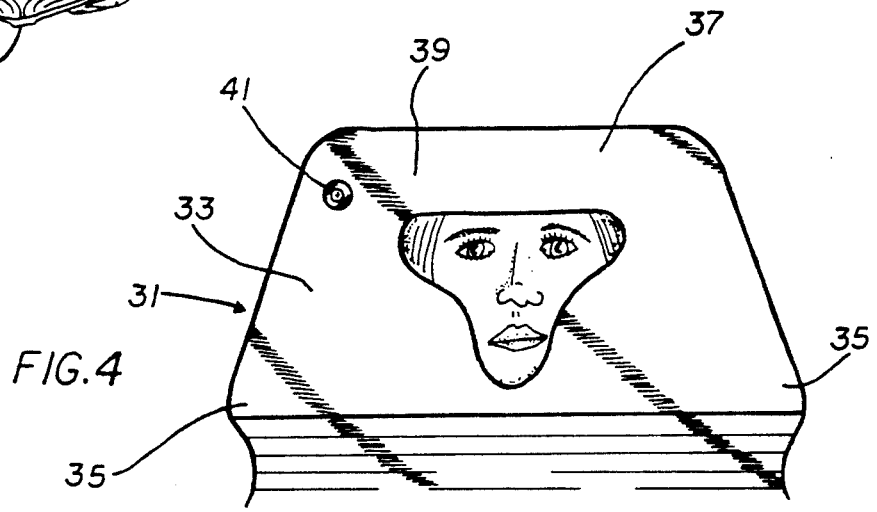
FIG. 4 is a partial bottom plan view of the chaise lounge, supporting a person.

The head support section 31 includes a head rest 39 that may be filled with filler material or may be inflatable. If the head rest 39 is inflatable, it must have an air valve 41, as shown in FIG. 4.

Figure 3:
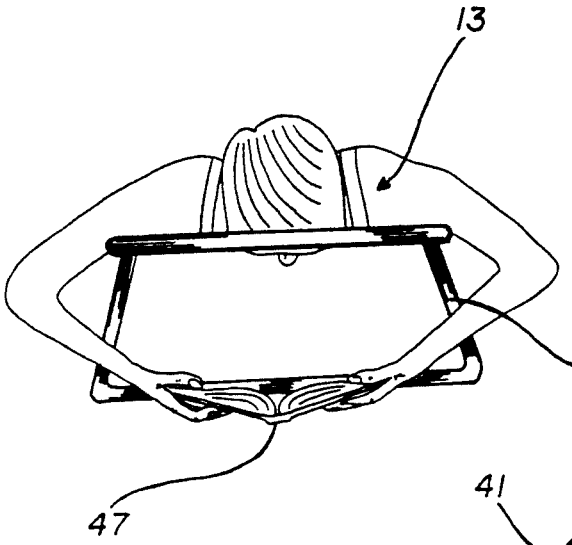
FIG. 3 is a front elevation of the chaise lounge, supporting a person.

The head support section 31 has an opening 43 passing through the head rest 39. The opening 43 is generally T-shaped or triangular, so it accommodates the face of a person 13 lying prone on the chaise lounge 11. As shown in FIGS. 3 and 4, the person 13 can lie prone on the chaise lounge 11 with his or her face inserted downward into the opening 41. The (triangular) T-shape of the opening 41 accommodates the person's eyes and the mouth.

The head support section 31 also has an area of reduced with 45, as shown best in FIG. 2. This reduced width is created by a pair of indentions in the sides 35 of the head support section 31. These indentions accommodate the person's arms, as shown in FIG. 3. Thus, a person 13 lying prone of the chaise lounge 11 can read a book or magazine 47 held beneath the chaise lounge 11, as shown in FIG. 3. The person 13 can look through the opening 43 and reach around the area of reduced width 45.

Figure 5:
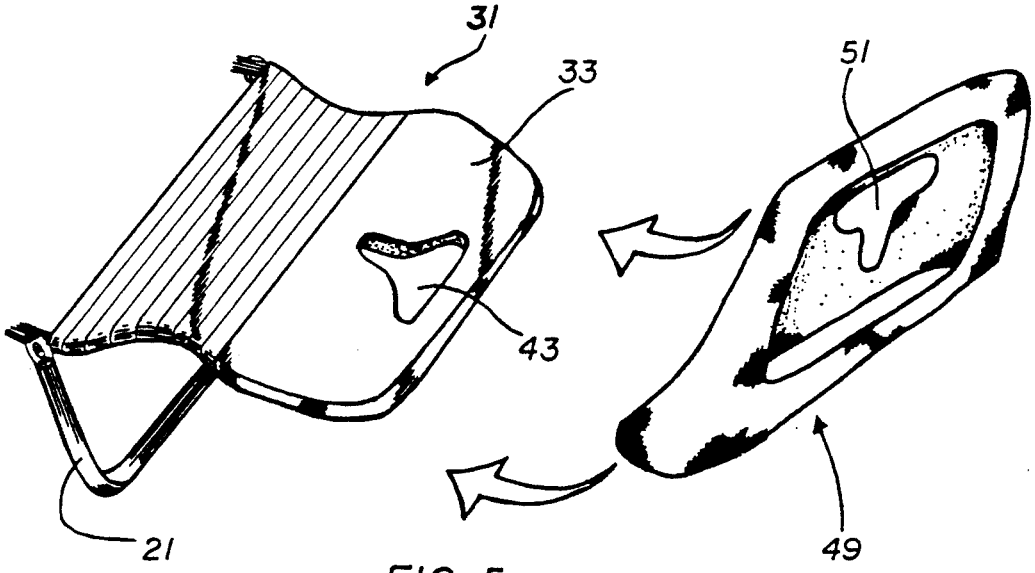
FIG. 5 is a partial perspective view of the chaise lounge, showing a removable cover.

For increased comfort, the chaise lounge 11 of the invention may also have a soft, removable cover 49 for the head support section 31, as shown in FIG. 5. The cover 49 may be made of any soft material, such as cloth. The cover 49 slips on and off over the top 37 of the head support section 31, so the cover 49 can be easily removed and cleaned. The cover 49 has a T-shaped or generally triangular opening 51 to match the opening 43 in the head rest 33, so the covered head rest 33 will still accommodate the person's face.

The invention has several advantages over the prior art. The chaise lounge 11 of the invention will comfortably support a person 13 in the prone position, by accommodating the person's face and arms. The invention also includes a soft, removable cover 49 to provide even more comfort.

The invention has been shown and described in only one embodiment. It should be apparent to those skilled in the art that the invention is not so limited, but is susceptible to various changes and modifications without departing from the spirit of the invention.

I claim:

1. A chaise lounge, comprising:

a body support section having a horizontal surface for supporting a prone person's torso;

a support for holding the body support section up off of an underlying surface;

a leg support section attached to one end of the body support section and having a horizontal surface for supporting the prone person's legs; and a head support section attached to the other end of the body support section and having a horizontal surface for supporting the person's head, shoulders, and upper chest, the head support section having an opening for accommodating the person's face, and an area of reduced width in order to accommodate the person's arms, wherein the area of reduced with is located entirely within the head support section.

2. A chaise lounge, as recited in claim 1, wherein the opening has an upper portion for accommodating the person's eyes and a lower portion for accommodating the person's mouth.

3. A chaise lounge, as recited in claim 1, wherein the head support section is inflatable.

4. A chaise lounge, as recited in claim 1, further comprising a soft, removable cover for the head support section.

5. A chaise lounge, comprising:

a body support section having a horizontal surface for supporting a prone person's torso;

a support for holding the body support section up off of an underlying surface;

a leg support section attached to one end of the body support section and having a horizontal surface for supporting the prone person's legs;

a head support section attached to the other end of the body support section and having a horizontal surface for supporting the person's head, shoulders, and upper chest, the head support section having an opening for accommodating the person's face, and an area of reduced width in order to accommodate the person's arms, wherein the area of reduced width is located entirely within the head support section; and a soft, removable cover for the head support section, wherein the cover also has an opening for accommodating the person's face.

6. A chaise lounge, comprising:

a body support section having a horizontal surface for supporting a prone person's torso, wherein the body support section has a pair of sides that are parallel along the entire length of the body support section;

a support for holding the body support section up off of an underlying surface;

a leg support section attached to one end of the body support section and having a horizontal surface for supporting the prone person's legs; and a head support section attached to the other end of the body support section and having a horizontal surface for supporting the person's head, shoulders, and upper chest, the head support section having an opening for accommodating the person's face and a pair of indentations in the sides of the head support section in order to accommodate the person's arms.

7. A chaise lounge as recited in claim 6, wherein the opening in the head support section is T-shaped.

8. A chaise lounge as recited in claim 6, wherein the head support section is inflatable.

9. A chaise lounge as recited in claim 6, further comprising a soft, removable cover for the head support section.

* * * * *